US006599430B2

(12) United States Patent
Vickio, Jr.

(10) Patent No.: US 6,599,430 B2
(45) Date of Patent: Jul. 29, 2003

(54) APPARATUS FOR CLEANING AND PRESSURE TESTING HYDRAULIC CONTROL SYSTEMS

(76) Inventor: Louis P. Vickio, Jr., 19715 Creekshore Dr., Katy, TX (US) 77449

( * ) Notice: Subject to any disclaimer, the term of this patent is extended or adjusted under 35 U.S.C. 154(b) by 95 days.

(21) Appl. No.: 09/992,444

(22) Filed: Nov. 16, 2001

(65) Prior Publication Data

US 2003/0094419 A1 May 22, 2003

(51) Int. Cl.[7] ..... E21B 37/00

(52) U.S. Cl. ..... 210/739; 210/167; 210/195.1; 210/196; 166/311; 137/15.05; 137/565.17; 137/565.26

(58) Field of Search ..... 210/167, 194, 210/195.1, 196, 739; 166/311; 137/15.05, 236.1, 565.17, 565.26

(56) References Cited

U.S. PATENT DOCUMENTS 3,677,001 A * 7/1972 Childers et al.
4,337,829 A * 7/1982 Banzoli et al.
5,357,999 A * 10/1994 Loth et al.
5,413,721 A * 5/1995 Schmitt

* cited by examiner

*Primary Examiner*—Betsey Morrison Hoey
(74) *Attorney, Agent, or Firm*—John R Casperson

(57) ABSTRACT

Method and multipurpose apparatus for internally cleaning a hydraulic control system are disclosed. The method is carried out by establishing a turbulent flow of cleaning fluid through the hydraulic control system and maintaining the turbulent flow until the hydraulic control system has been cleaned without diverting a portion of cleaning fluid through a bypass valve, by use of a variable speed pump coupled to a fluid accumulator. The apparatus comprises a filtration system for cleaning up recovered fluid, a primary pump, an accumulator, a first manifold for fluid injection, a second manifold for fluid recovery, and a return conduit from the second manifold to the filter.

16 Claims, 1 Drawing Sheet

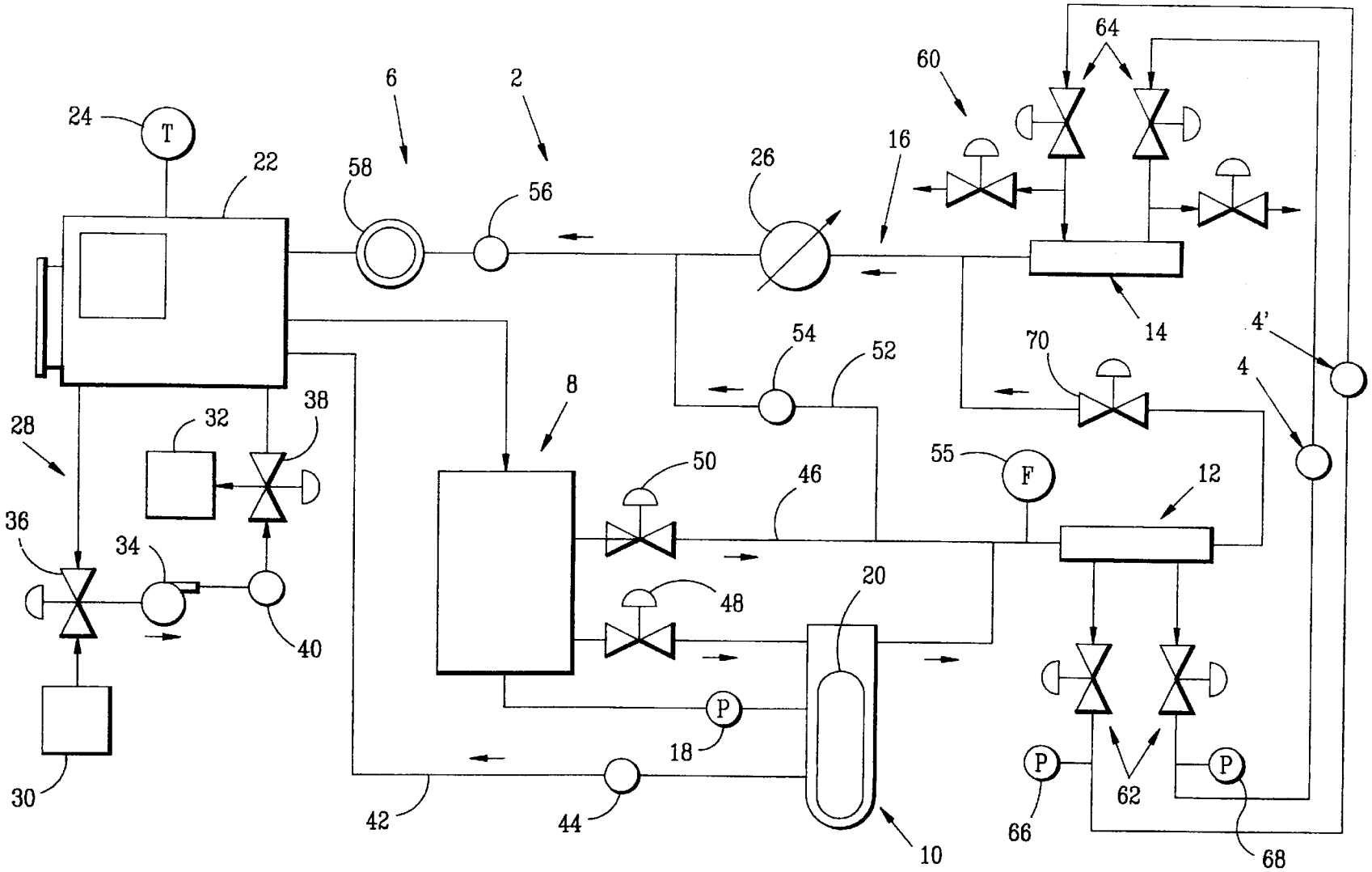
4'
4
68
12
14
64
62
70
P
P
66
F
55
60
10
16
52
20
54
46
26
48
50
18
P
44
8
2
56
6
58
42
38
40
22
32
T
24
34
28
36
30

APPARATUS FOR CLEANING AND PRESSURE TESTING HYDRAULIC CONTROL SYSTEMS

FIELD OF THE INVENTION

In one aspect, this invention relates to a multipurpose apparatus having the capability to internally clean a hydraulic system. In another aspect, this invention relates to a method for internally cleaning a hydraulic system.

BACKGROUND OF THE INVENTION

As oil and gas production has moved into deeper water with production equipment placed on the seabed floor, it has become necessary to use remotely operated well control devices. These control devices are controlled from the surface via a hydraulic control system having numerous components and are typically located on the subsea wellhead tree.

It is very important that everything in the system be extremely reliable. The inability to actuate a controller on the seabed floor can result in lost production, which, because of the inaccessibility of the controller, may continue for many days, resulting in large losses of earnings and high costs of repairs. Reliable controller performance is also important for safety functions, and to protect the environment. In extreme cases, the failure of a controller to perform can have catastrophic consequences.

Contaminated hydraulic fluid can lead to failures in hydraulic components and controls. Particulate contamination, for example, in the hydraulic fluid can, over time, damage the seals in the controllers, which are typically valves with hydraulic actuators. Cleaning the hydraulic system reduces this risk and therefore has become a standard practice. Particulate contamination is removed from the system by circulating pre-cleaned hydraulic fluid or solvent through the lines. This flushing of the particulates is typically carried out utilizing air over hydraulic pumps, diesel engine driven triplex pumps, and electric motor driven triplex pumps. The cleanliness of the fluid is quantified according to a specification called NASA 1638, which was developed by NASA for the space program. After flushing, the hydraulic system is pressure tested for leakage.

The hydraulic control lines in such systems are typically several thousand feet long and of small diameter. The control lines are engineered so as to provide reliable operation of the control devices, rather than to facilitate cleaning. High flow rate is not required to actuate the control devices on the seabed floor, but turbulent flow through the lines is essential to efficiently sweep the particulates to the surface for capture. High pressure is required to cause turbulent flow, but it cannot be too high, or the pressure capabilities of the hydraulic system may be exceeded, causing damage to the components.

One prior art solution to this problem was to limit the output pressure of the cleaning fluid pump by diverting a portion of the fluid through a bypass valve set to open at a pre pressure. Normal operation in this prior art solution was to operate with the bypass valve open. This procedure has several draw-backs. One is that the diverted cleaning fluid will heat up, which will necessitate utilization of a bigger cooler. The resulting system will be less compact and heavier than a system without a cleaning fluid cooler, or a system with a small cooler, which is a drawback for use on offshore oil platforms. The system will also be more expensive to build and operate. Another is that a larger pump motor will be required, as a portion of its work will be wasted in heating the cleaning fluid. This adds weight to the unit, expense to its construction, and higher operating costs. A further drawback is that motor life will be shortened due to its continuous operation.

Another prior art solution was to couple the pump to a pressure switch and turn the pump off and on between high and low pressure limits. This procedure is incapable of maintaining optimal flow of cleaning fluid through the lines.

These problems are worsened where the conditions of application require low flow at high pressures to clean the system.

An apparatus which overcomes these shortcomings would be very desirable.

OBJECTS OF THE INVENTION

It is an object of this invention to provide a method to obtain optimized turbulent flow in a hydraulic cleaning system without bypassing fluid, which can introduce excessive heat to the fluid and degrade it.

It is a further object of this invention to provide a method for dissipating heat that may come from long periods of turbulent flow through a hydraulic system in the process of being cleaned.

It is a further object of this invention to provide a hydraulic cleaning system which has the further capability of supplying increased static pressure for hydrostatic pressure test on hydraulic components and is adaptable to act as a hydraulic pressure control system to operate valve and other hydraulic equipment that has been flushed and pressure tested by the unit.

It is a further object of this invention to unitized assembly for cleaning hydraulic systems that is easily portable and which can be transported via trailer, work boat, helicopter, or other conveyance.

It is an additional object of this invention to provide a hydraulic cleaning unit that does not require transport of flammable fuels to operate it and which can be easily made explosion proof and intrinsically safe to operate in a class I Div II hazardous area without igniting a gaseous atmosphere.

It is an additional object to provide a unit that does not emit any hazardous emissions and can be operated in an enclosed area safely as well as to provide a unit which runs quietly and does not add to poise pollution.

It is an additional object of this invention to provide a packaged cleaning system that is adaptable for providing information for flow rate, total fluid consumption, pressure, and temperature of the fluid. It can also provide over pressure protection and hours of operation. This unit is easily interfaced for computer date logging technology.

It is yet another object of the invention to provide a unit capable of taking a sample of fluid on the fly while the unit is flushing so it can be analyzed while flushing continues. The unit is adaptable so it may continue to flush while samples of fluid are automatically analyzed with the results may be logged to a computer and to perform an automatic shutdown when the system is to be clean.

SUMMARY OF THE INVENTION

In one embodiment, the invention provides a multipurpose injector unit for injecting liquid into a hydraulic control system. The unit comprises a filtration system, a primary pump, an accumulator, a first manifold, a second manifold, and a flow path means.

The filtration system is for receiving a contaminated liquid and forming a filtered liquid. The primary pump is in flow communication with the filtration system and receives filtered liquid from the filtration system. The accumulator is in flow communication with the pump and receives filtered liquid from the pump and stores the filtered liquid at an elevated pressure. The first manifold is in flow communication with the accumulator and receives filtered liquid from the accumulator and distributes filtered liquid into the hydraulic control system. The second manifold is positioned to receive contaminated liquid from the hydraulic control system. The flow path means forms a flow path between the second manifold and the filtration system to provide for the filtering of the contaminated liquid in the filtration system.

In another embodiment of the invention, there is provided a method for internally cleaning a hydraulic control system. The method is carried out by establishing a turbulent flow of cleaning fluid through the hydraulic control system, and maintaining the turbulent flow until the hydraulic control system has been cleaned without diverting a portion of cleaning fluid through a bypass valve, by use of a variable speed pump coupled to a fluid accumulator.

BRIEF DESCRIPTION OF THE DRAWINGS

The FIGURE is a schematic illustration showing certain features of the present invention.

DETAILED DESCRIPTION OF THE INVENTION

With reference to the FIGURE, the invention provides a multi-purpose injector unit 2 for injecting liquid into a hydraulic control system 4, 4'. The unit comprises a filtration system 6, a primary pump 8, an accumulator 10, a first manifold 12, a second manifold 14, and a flow path means 16.

The filtration system is for receiving a contaminated liquid and forming a filtered liquid. The primary pump is in flow communication with the filtration system and receives filtered liquid from the filtration system. The accumulator is in flow communication with the pump and receives filtered liquid from the pump and stores the filtered liquid at an elevated pressure. The first manifold is in flow communication with the accumulator and receives filtered liquid from the accumulator and distributes filtered liquid into the hydraulic control system The second manifold is positioned to receive contaminated liquid from the hydraulic control system. The flow path means forms a flow path between the second manifold and the filtration system to provide for the filtering of the contaminated liquid in the filtration system.

The primary pump is preferably an electric, variable speed pump. More preferably, the pump employs a dry sump system that allows the primary pump to run at low speeds while constantly lubricating the main bearing to ensure longevity and reliability of the primary pump In order to reduce operating costs and increase pump life, a pressure sensor is operatively coupled to the accumulator and the primary pump to activate and deactivate the primary pump responsive to pressure within the accumulator. The accumulator is preferably of the type which includes an internal gas-filled bladder 20.

As a rule, low pressure accumulators have bladders and high pressure accumulators have pistons inside them. On one side of the bladder resides about 1,000 psi of nitrogen. As the pump pumps fluid into the accumulator the pressure shrinks the bladder and the nitrogen compresses. Now when the fluid flows out it will be let out with pressure until the pressure gets down to the lower limit switch. Then the pump comes on and builds the pressure up again This is used to flush actuators for valves that use around one gallon of fluid to operate the valve. So we operate the valve back and forth to flush and this saves the triplex pump.

The unit preferably further includes a primary storage tank 22 positioned between the filtration system and the primary pump. The filtration system discharges to the primary storage tank and the primary pump draws from the primary storage tank. A temperature sensor 24 is preferably operative associated with the primary storage tank. If the fluid within the primary storage tank becomes too hot due to prolonged periods of turbulent flow, a cooler 26 located in the flow path means can be activated to reduce the temperature. The cooler is preferably an air cooled radiator.

The unit also preferably includes a roll over system 28 operatively associated with the primary storage tank. The roll over system includes a reservoir 30 for fresh liquid, an ancillary storage tank 32 for storing liquid, and a secondary pump 34 having an inlet selectively connectable to draw liquid from either the primary storage tank or the fresh cleaning liquid reservoir and an outlet selectively connectable to discharge liquid to either the ancillary storage tank or the primary storage tank. The pump can be coupled by three way valves 36 and 38 located in its inlet and outlet flow paths. A sock filter can be positioned between the secondary pump and the three way valve 38 if desired.

The rollover system permits the fluid in the tank to be rolled through a filter to allow it to be cleaned on its own or while the primary pump is cleaning or pressure testing a hydraulic system This roll over system can also flush an ancillary tank before loading it into the unit's storage tank, while the unit is flushing or pressure testing a hydraulic system with the primary pump. This system preferably includes one or more tanks that reside in the package.

The valve 36 can be positioned to accept fluid from the tank 22, or from the outside source 30. If the fluid comes from tank 22 the pump can circulate the fluid in the tank 22 through the filter 40 and back into tank 22, depending on the configuration of valve 38. Tank 22 can be emptied by configuring the valves to allow the pump flow from the tank 22 to an outside receptacle 32. Also, these valves can be configured so they can circulate fluid from an ancillary tank, through the filter and back into the ancillary tank.

Normally, the liquid in the system will be hydraulic cleaning fluid. However, in situations where it is desired to operate the hydraulic system, the liquid will be hydraulic fluid. In situations where it is desired to dewater the system, a dewatering fluid such as methanol can be used. In the event that the system is to be used to inject well control fluid into a subsea wellhead, for example, to control paraffin deposits or hydrates, the liquid can be selected depending on the needed functionality.

To protect the accumulator from over-pressurization, it is desirable that the system contain a relief valve. In the illustrated embodiment, a first normally-closed pressure relief line 42 establishes a flow path between the accumulator and the primary storage tank. The line contains a pressure relief valve 44.

In situations where the functionality of the accumulator is not needed, the illustrated embodiment provides for direct injection from the primary pump. A selectively openable bypass line 46 is seen to establish a flow path between the primary pump and the first manifold. In order to use the line 46, valve 48 in the bypass line is opened, and a valve 50 in a line between the pump and the accumulator is closed.

In order to prevent overpressuring in this mode of operation, it is desirable to provide pressure relief system. In the illustrated embodiment, a selectively openable pressure control line 52 establishes a flow path between the selectively openable bypass line and the means forming a flow path between the second manifold and the filtration system. The pressure control line contains a flow control valve 54. Flow going to the manifold can be by flow meter 55, and flow meter 55 and flow control valve 54 can be electronically coupled if desired. Protection from overpressuring is also provided by a normally-closed emergency relief valve 70 positioned in a conduit connecting the first manifold and the flow path means 16.

The filtration system can take many forms. In the illustrated embodiment, the system comprises a sock filter 56 near an upstream end thereof and a canister filter 58 near a downstream end thereof In order to determine when the system has been adequately cleaned, the multipurpose unit preferably further comprises a mans 60 for withdrawing liquid samples for testing connected to the second manifold. A sample port is highly suitable. The multipurpose unit is preferably further provided with valve means 62, 64 operatively associated with the first manifold and the second manifold, respectively, for isolating the hydraulic control system from the injector unit. The hydraulic system can then be pressured up, isolated, and tested for leaks via pressure gauges 66, 68, for example, to determine the retained pressure in the hydraulic control system after being isolated.

The method of one preferred embodiment of the invention is carried out by establishing a turbulent flow of cleaning fluid through the hydraulic control system, and maintaining the turbulent flow until the hydraulic control system has been cleaned without diverting a portion of cleaning fluid through a bypass valve, by use of a variable speed pump coupled to a fluid accumulator. It is further preferred to recover a flow of contaminated cleaning fluid from the hydraulic control system, filter the contaminated fluid to form a filtered fluid, and recirculate the filtered fluid to the variable speed pump. It is still further preferred to sense the pressure in the accumulator and cycle the variable speed pump in response to the sensed pressure.

Overall, the inventive unit is able to flush anything from very long (52 mile) umbilicals to the very small one gallon capacity actuators. It is able to pressure test most everything used in the oil and gas industry and handle most any kind of fluid used by the oil and gas industry. While certain preferred embodiments of the invention have been described herein, the invention is not to be construed as being so limited, except to the extent that such limitations are found in the claims.

What is claimed is:

1. A multi-purpose injector unit for injecting liquid into a hydraulic control system, said injector unit comprising a. a filtration system for receiving a contaminated liquid and forming a filtered liquid, b. a primary pump in flow communication with the filtration system to receive filtered liquid from the filtration system, c. an accumulator in flow communication with the pump to receive filtered liquid from the pump and storing said filtered liquid at an elevated pressure, d. a first manifold in flow communication with the accumulator to receive filtered liquid from the accumulator and distributing filtered liquid into the hydraulic control system, e. a second manifold positioned to receive contaminated liquid from the hydraulic control system, and f. means forming a flow path between said second manifold and said filtration system to provide for the filtering of said contaminated liquid in said filtration system.

2. A multi-purpose unit as in claim 1 wherein the primary pump comprises an electric, variable speed pump.

3. A multi-purpose unit as in claim 2 further comprising a pressure sensor operatively coupled to the accumulator and the primary pump to activate and deactivate the primary pump responsive to pressure within the accumulator.

4. A multi-purpose unit as in claim 3 wherein the accumulator includes an internal gas-filled bladder.

5. A multi-purpose unit as in claim 4 further comprising a primary storage tank positioned between the filtration system and the primary pump, wherein the filtration system discharges to the primary storage tank and the primary pump draws from the primary storage tank.

6. A multi-purpose unit as in claim 5 further comprising a roll over system operatively associated with the primary storage tank, said roll over system including a reservoir for fresh liquid, an ancillary storage tank for storing liquid, a secondary pump having an inlet selectively connectable to draw liquid from either the primary storage tank or the fresh cleaning liquid reservoir and an outlet selectively connectable to discharge liquid to either the ancillary storage tank or the primary storage tank.

7. A multi-purpose unit as in claim 6 further comprising a first normally-closed pressure relief line establishing a flow path between the accumulator and the primary storage tank.

8. A multi-purpose unit as in claim 6 further comprising a selectively openable bypass line establishing a flow path between the primary pump and the first manifold.

9. A multi-purpose unit as in claim 8 further comprising a selectively openable pressure control line establishing a flow path between the selectively openable bypass line and the means forming a flow path between said second manifold and said filtration system.

10. A multi-purpose unit as in claim 1 wherein the filtration system comprises a sock filter near an upstream end thereof and a canister filter near a downstream end thereof.

11. A multipurpose unit as in claim 1 further comprising a means for withdrawing liquid samples for testing connected to the second manifold.

12. A multipurpose unit as in claim 1 further comprising valve means operatively associated with the first manifold and the second manifold for isolating the hydraulic control system from the injector unit.

13. A multipurpose unit as in claim 12 further comprising pressure gauges for determining retained pressure in the hydraulic control system after being isolated.

14. A method for internally cleaning a hydraulic control system comprising establishing a turbulent flow of cleaning fluid through the hydraulic control system, and maintaining said turbulent flow until the hydraulic control system has been cleaned without diverting a portion of cleaning fluid through a bypass valve, by use of a variable speed pump coupled to a fluid accumulator.

15. A method as in claim 14 further comprising recovering a flow of contaminated cleaning fluid from the hydraulic control system, filtering said contaminated fluid to form a filtered fluid, and recirculating said filtered fluid to said variable speed pump.

16. A method as in claim 15 further comprising sensing a pressure in said accumulator, and cycling said variable speed pump in response to said pressure.

* * * * *